US005368057A

United States Patent [19]

Lubkeman et al.

[11] Patent Number: 5,368,057

[45] Date of Patent: Nov. 29, 1994

[54] COLLAPSIBLE ICE FISHING SHELTER

[76] Inventors: Raymond F. Lubkeman, 1432 N. Concord Dr., Janesville, Wis. 53545; David R. Lubkeman, 3928 BrynMawr Dr., Janesville, Wis. 53546

[21] Appl. No.: 934,765

[22] Filed: Aug. 24, 1992

[51] Int. Cl.[5] ..... E04H 15/44

[52] U.S. Cl. ..... 135/133; 135/901; 135/137; 135/153

[58] Field of Search ..... 135/901, 900, 103, 88, 135/106, 107, 109, 113, 120; 403/83, 87, 109, 110; 292/339

[56] References Cited

U.S. PATENT DOCUMENTS

| | | | |
|---|---|---|---|
| Re. 26,140 | 1/1967 | Schoenike | 135/4 |
| 2,528,721 | 11/1950 | Brockman et al. | 135/109 |
| 2,571,362 | 10/1951 | Hervey | 135/88 X |
| 2,632,454 | 3/1953 | Skogen | 135/901 X |
| 2,717,160 | 9/1955 | Schmidt et al. | 280/20 |
| 3,009,471 | 11/1961 | Rossiter | 135/88 |
| 3,157,185 | 11/1964 | Shoenike | 135/4 |
| 3,242,935 | 3/1966 | Williams | 135/5 |
| 3,507,293 | 4/1970 | Du Bray | 135/4 |
| 3,509,891 | 5/1970 | De Bolt | 135/4 |
| 3,739,536 | 6/1973 | Ward | 52/63 |
| 3,760,826 | 9/1973 | Rasmussen | 135/1 |
| 3,826,270 | 7/1974 | Hentges | 135/4 |
| 3,874,398 | 4/1975 | Hendrickson | 135/4 |
| 4,067,346 | 1/1978 | Husted | 135/4 |
| 4,084,597 | 4/1978 | Compton | 135/1 |
| 4,239,247 | 12/1980 | Hinz | 280/12 |
| 4,252,136 | 2/1981 | Kruczynski | 135/1 |
| 4,462,631 | 7/1984 | Lange | 135/88 X |
| 4,683,672 | 8/1987 | Davis | 135/901 X |
| 4,917,127 | 4/1990 | Marble et al. | 135/87 |
| 4,926,893 | 5/1990 | Klopfenstein et al. | 135/106 |
| 4,938,243 | 7/1990 | Foster | 135/105 |

FOREIGN PATENT DOCUMENTS

| | | | |
|---|---|---|---|
| 2924256 | 12/1980 | Germany | 135/120 |
| 2054002 | 2/1981 | United Kingdom | 135/120 |

OTHER PUBLICATIONS

Ice Fishing Secrets, by Al Linder, Doug Stange and Dave Genz (In-Fisherman, Inc., Brainerd, Minn., 1991), pp. 26-30, copyright 1991 In-Fisherman, Inc.

*Primary Examiner*—Lanna Mai

*Attorney, Agent, or Firm*—Lathrop & Clark

[57] ABSTRACT

A thermoformed plastic base has a collapsible frame which supports a flexible fabric covering which defines an ice fishing enclosure. A first brace extends frontwardly from the base and surrounds an ice fishing hole and engages against the lower edge of the flexible covering. A second brace is engaged with the first brace and extend frontwardly and upwardly from the base to engage against the flexible covering above the first brace. The engaged segments of the first and second braces restrict portion of the flexible covering from deflection toward the base and thereby define a volume adjacent the enclosed space above the ice fishing hole which is protected from interference from the flexible covering. An angler may jig a fishing rod in the defined volume without the wind blowing the flexible covering into conflict with the rod. The base preferably has a hook and a pin mounted on opposite sides for connection of two like shelters. Doors in the adjacent flaps of engaged shelters may be opened to provide communication between the shelters. The flexible covering preferably has a hem which is weighted to surround the ice fishing region and prevent wind infiltration into the enclosure.

4 Claims, 4 Drawing Sheets

COLLAPSIBLE ICE FISHING SHELTER

FIELD OF THE INVENTION

The present invention relates to portable shelters in general and to collapsible enclosures for use in ice fishing in particular.

BACKGROUND OF THE INVENTION

Ice fishing has become a popular winter activity. By fishing on frozen lake surfaces, anglers, even those without access to boats, may select any spot on a lake for best fishing results. With increased popularity has come a greater dissemination of ice fishing knowledge and techniques and a demand for increasingly sophisticated equipment. The modern ice fisherman may employ electronic depth finders, tip-ups, sophisticated lures and extremely sensitive jigging rods.

For extended fishing at low temperatures, anglers employ some type of wind break or shelter. Where local regulations allow, semi-permanent ice fishing shelters may be erected on the ice and left in one position throughout the winter. These shelters have rigid walls and roofs with internal floor openings through which ice holes are drilled. Although these rigid walled shelters provide adequate protection from winds across the ice, their size and weight make them difficult to move. As in any type of fishing, for best results it is necessary to go where the fish are biting. To facilitate the location of the best fishing spot, portable ice fishing shelters have been developed which are light-weight and capable of being stowed, moved, and erected in a matter of minutes.

One known type of ice fishing shelter employs a plastic sled-like base to which a tubular metal framework is connected. A flexible fabric covering is deployed over the framework to form a tent-like fishing enclosure. Enclosures of this type which have a fishing hole located within the plastic base must have base dimensions which are undesirably large and difficult to transport. To minimize base dimensions, fishing shelters have been developed which utilize a bent rod brace which projects outwardly from the base over the ice fishing hole and which spaces the flexible covering frontwardly from the base.

One of the most effective ice fishing techniques is jigging, in which a line is dropped from a hand-held fishing rod through a hole in the ice to deploy the lure in close proximity to the lake bottom. The angler then repeatedly lifts the lure over about a two foot distance, then returns the lure to the lake bottom. Different patterns and rates of lifting, returning, and jiggling of the rod may be employed which are best suited to a particular species of fish. However, in the close confines of a flexible fabric covering fishing shelter, the flexible front flap of the shelter may be blown inward by lake winds. This inward deflection of the shelter covering is likely to interfere with the precise jigging motion of the angler. Furthermore, fishing techniques which employ extremely sensitive bobbers may be activated by a slight nudge on the pole or line from the deflected covering, resulting in a false strike.

What is needed is a compact, light-weight, easily transportable fishing shelter which does not interfere with the sheltered angler's rod and line. Furthermore, an easily transportable shelter is needed which may accommodate multiple anglers.

SUMMARY OF THE INVENTION

The collapsible ice fishing shelter of the present invention has a thermoformed plastic base which has a floor with upstanding side walls. A collapsible frame formed of tubular metal members is hingedly connected to the base. A flexible fabric covering surrounds and covers the frame. A first brace extends outwardly from the base and is adapted to encircle an ice fishing hole formed in a sheet of ice above a body of water. The flexible covering is connected to the first brace. The second brace is connected to the first brace and extends upwardly and frontwardly from the base to engage against the flexible covering at a location above the first brace. The engaged second brace restricts the inward deflection of the flexible covering so as to define a generally undeflected segment of covering between the second brace and the first brace, the undeflected segment defining a volume for rod movement without interference with the shelter. The flexible covering has a lower hem with a weight, preferably in the form of a chain, located therein. The weighted hem serves to form an air seal along the base of the flexible covering which prevents the infiltration of wind.

The shelter is preferably provided with a rotatable hook on one side and a pin on the other side such that two identical shelters may be placed back to back and connected together. The rear flap of the shelter flexible covering has a zippered door which may be rolled out of the way to provide for communication between the connected shelters.

It is an object of the present invention to provide an ice fishing shelter with a volume surrounding a ice fishing hole which does not interfere with a fishing rod.

It is also an object of the present invention to provide an ice fishing shelter having an air infiltration resistent flexible covering which engages with an ice surface.

It is another object of the present invention to provide an ice fishing shelter which may be joined with a like shelter to form an enlarged enclosed volume.

It is a further object of the present invention to provide an ice fishing shelter which is compact, lightweight, and easily transportable.

It is another object of the present invention to provide a brace assembly for retrofitting an ice fishing shelter to obtain an interference free ice fishing region.

Further objects, features and advantages of the present invention will become apparent from the following specification when taken in conjunction with the accompanying drawings.

DESCRIPTION OF THE PREFERRED EMBODIMENTS

Figure 1:
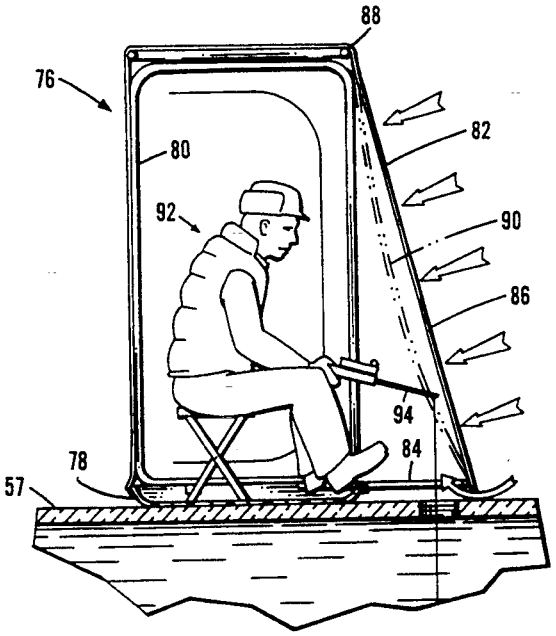
FIG. 1 (PRIOR ART)
FIG. 1 is a cross sectional view of a prior art ice fishing shelter with schematic arrows indicating incidence of wind.
Figure 2:
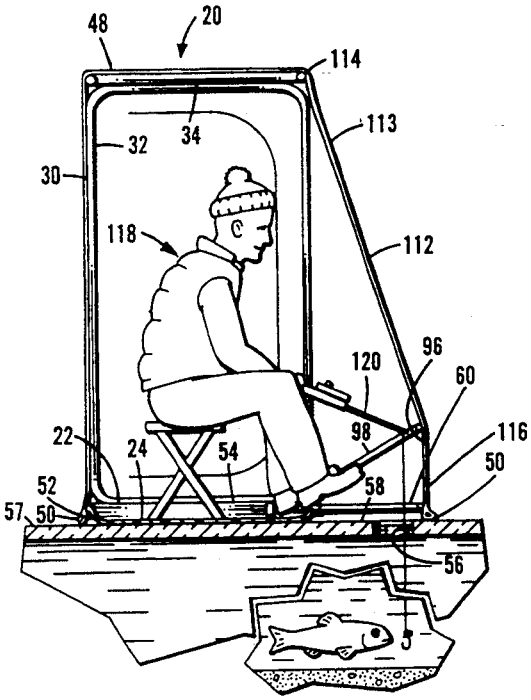
FIG. 2 is a cross sectional view of the ice fishing shelter of the present invention.
Figure 3:
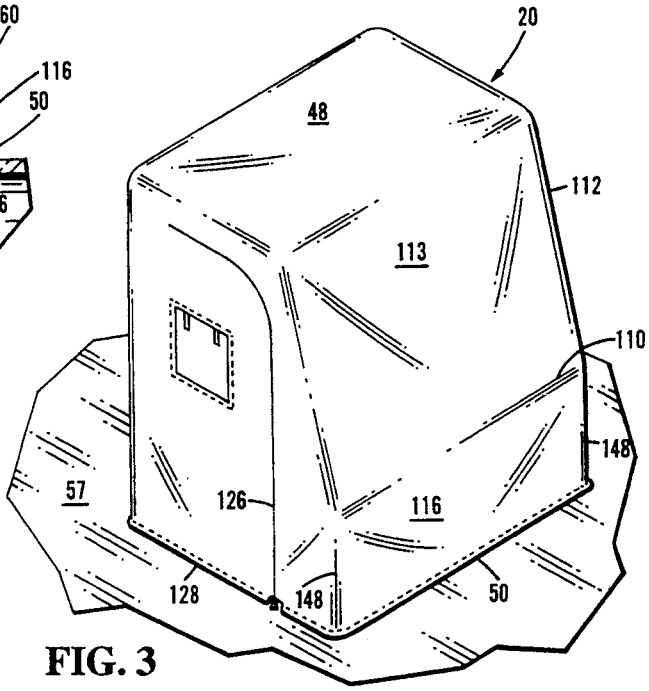
FIG. 3 is an isometric view of the ice fishing shelter of FIG. 2.
Figure 4:
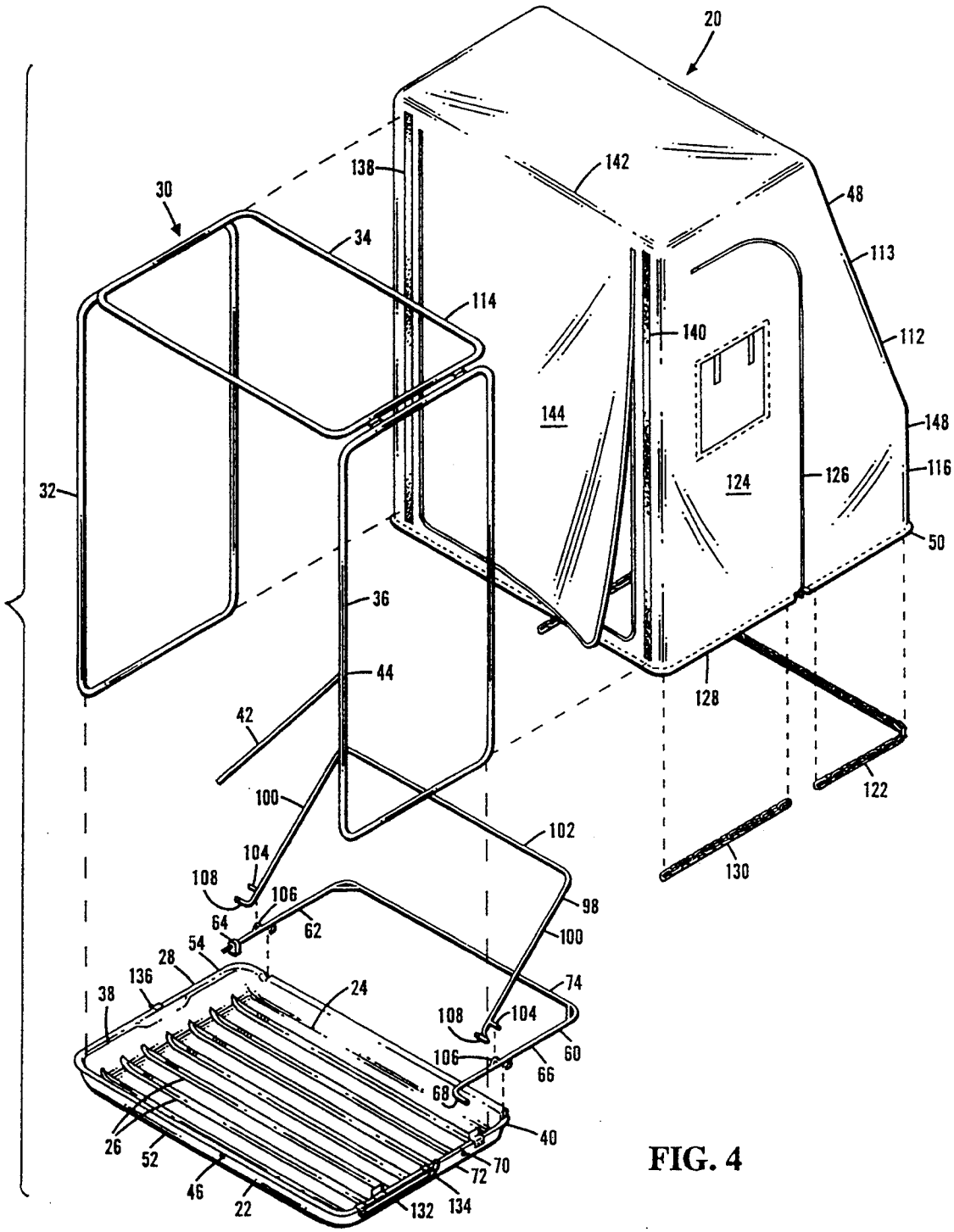
FIG. 4 is an exploded isometric view of the ice fishing shelter of FIG. 3.

Referring more particularly to FIGS. 1–9, wherein like numbers refer to similar parts, an ice fishing shelter 20 is shown in FIGS. 2–4. The ice fishing shelter 20 is a collapsible enclosure which is suited for rapid disassembly and erection. The shelter 20 has a thermoformed thermoplastic base 22 into which the components of the shelter may be packed for compact transportation. The base 22 has a floor 24 with a plurality of lateral depressions 26 formed therein which stiffen the base and which serve as runners when the base is dragged along a frozen surface. The base 22 has an upstanding peripheral side wall 28 which extends upwardly from the floor 24.

A collapsible frame 30, best shown in FIG. 4, is composed of three tubular metal frame members 32, 34, 36 preferably formed of galvanized steel. A first frame member 32 is hingedly connected to the base side wall 28. The second frame member 34 defines the top of the ice fishing shelter 20 and is hingedly connected to the top of the rectangular tubular first frame member 32. A third frame member 36 is hingedly connected to the second frame member 34 and is received within a groove 38 formed in a lip 40 which extends outwardly from the base side wall 28. An insertable rod 42 connects a mid point 44 on the first frame member 32 to a rear connection point 46 on the base side wall 28.

A flexible covering 48 is tailored to surround and cover the frame 30. The flexible covering 48 is preferably formed of a water repellant, opaque, durable material, and preferably formed of a 50/50 blend of polyester and cotton such as polaris cloth manufactured by Graniteville. Other materials, including different blends of polyester and cotton, or nylon may also be employed. The flexible covering 48 preferably has a lower peripheral hem 50 which is connected such as by staples to the rear 52 and right side 54 of the base 22. As best shown in FIG. 2, the ice fishing shelter 20 is adapted for positioning on the frozen surface of a lake, pond, or other body of water, with the base 22 spaced rearwardly from an ice fishing hole 56 formed in the ice 57. An ice fishing region 58 frontwards of the base 22 is enclosed by the flexible covering 48, but is not covered by the base 22. The ice fishing region 58 is generally defined and surrounded by a first brace 60 which is a bent metal rod which engages against the flexible covering in the vicinity of the hem 50 and is attached thereto, preferably by releasable ties or tabs.

As shown in FIG. 4, the first brace 60 has a first frontwardly extending segment 62 which is supported within the base 22 by a wooden block 64 which engages against the base floor 24. The first brace 60 has a second frontwardly extending segment 66 which has a hook 68 which engages in a hole 70 formed in the side wall 28 at the left side 72 of the base. A front segment 74 of the first brace 60 extends between the first and second frontwardly extending segments 62, 66 and defines the frontward limits of the ice fishing region 58. The front segment 74 of the first brace is preferably secured to the flexible covering 48 by a series of hook and loop fastener tabs (not shown).

The prior art ice fishing shelter 76, shown in FIG. 1, has a base 78 with a collapsible frame 80 and a flexible covering 82. The prior art shelter 76 also has a frontwardly extending brace 84 which engages against the flexible covering and which defines an ice fishing region. The prior art shelter 76 has a flexible covering 82 with a front flap 86 which extends from a top frame member 88 to the frontwardly extending brace 84. The front flap is thus restricted from movement along two lines at its top and bottom, but is free to flex inwardly on the incidence of a gust of wind (illustrated by schematic arrows). As illustrated by the phantom lines 90 in FIG. 1, the inwardly displaced front flap 86 may interfere with the ice fishing rod of the angler 92 seated within the shelter 76. This interference of the flexible covering 82 with the rod 94 hampers the angler in detecting fish strikes and also interferes with the ability of the angler to raise and lower the rod in a desired fashion.

As shown in FIGS. 2 and 4, the ice fishing shelter 20 of the present invention defines a volume 96 above the ice fishing region 58 which is free of interference from the flexible covering 48. The volume 96 is defined by a second brace 98 which extends upwardly and frontwardly from the base 22. The second brace 98 has two frontwardly extending segments 100 joined by a front segment 102. Each frontwardly extending segment 102 has a sidewardly extending pin 104 which is pivotally engaged with a loop 106 formed on each first brace frontwardly extending segment 62, 66. Each second brace frontwardly extending segment 100 also has a hook 108 rearward of the pin 104 which extends beneath and engages with the frontwardly extending segments 62, 66 of the first brace 60. The pin, loop and hook engagement of the first and second braces 60, 98, allows the second brace 98 to be conveniently stored in a horizontal position above the first brace 60 within the base 22.

To assemble the shelter 20, the second brace frontwardly extending segments 100 are flexed inwardly such that the pins 104 are positioned to enter the first brace loops 106. The two braces 60, 98, are thus engaged together in a secure but easily releasable manner. No tools such as screwdrivers or wrenches are needed, and the structure may be erected effectively even by an angler with gloved hands.

As shown in FIG. 2, the front segment 102 of the second brace 98 engages with the flexible covering 48 along a line 110 spaced above the first brace front segment 74. The front flap 112 of the flexible covering 48 is thus divided into two portions: an upper portion 113 which extends from the front segment 114 of the top frame member 34 to the front segment 102 of the second brace, and a lower portion 116 which extends from the front segment 102 of the second brace 98 to the front segment 74 of the first brace 60. The lower portion 116 is substantially smaller than the upper portion 113 and hence less subject to inward deflection by the wind.

The second brace 98 front segment 102 engages the flexible covering at a line 110 less than two feet, preferably approximately 20 inches, above the first brace 60 and the surface of the ice 57. The narrow lower portion 116 of the front flap 112, being supported against the second brace 98 and the first brace 60, will not be deflected inward significantly by air pressure thereon. The angler 118 will then be able to raise and lower his rod 120 without interference from the flexible covering 48. The distance between the front segments 74, 102 of the braces 60, 98 corresponds to approximately the length over which an angler jigs his rod while ice fishing. The lower portion 116 of the flexible covering is thus kept small, and hence more rigid.

Figure 5:
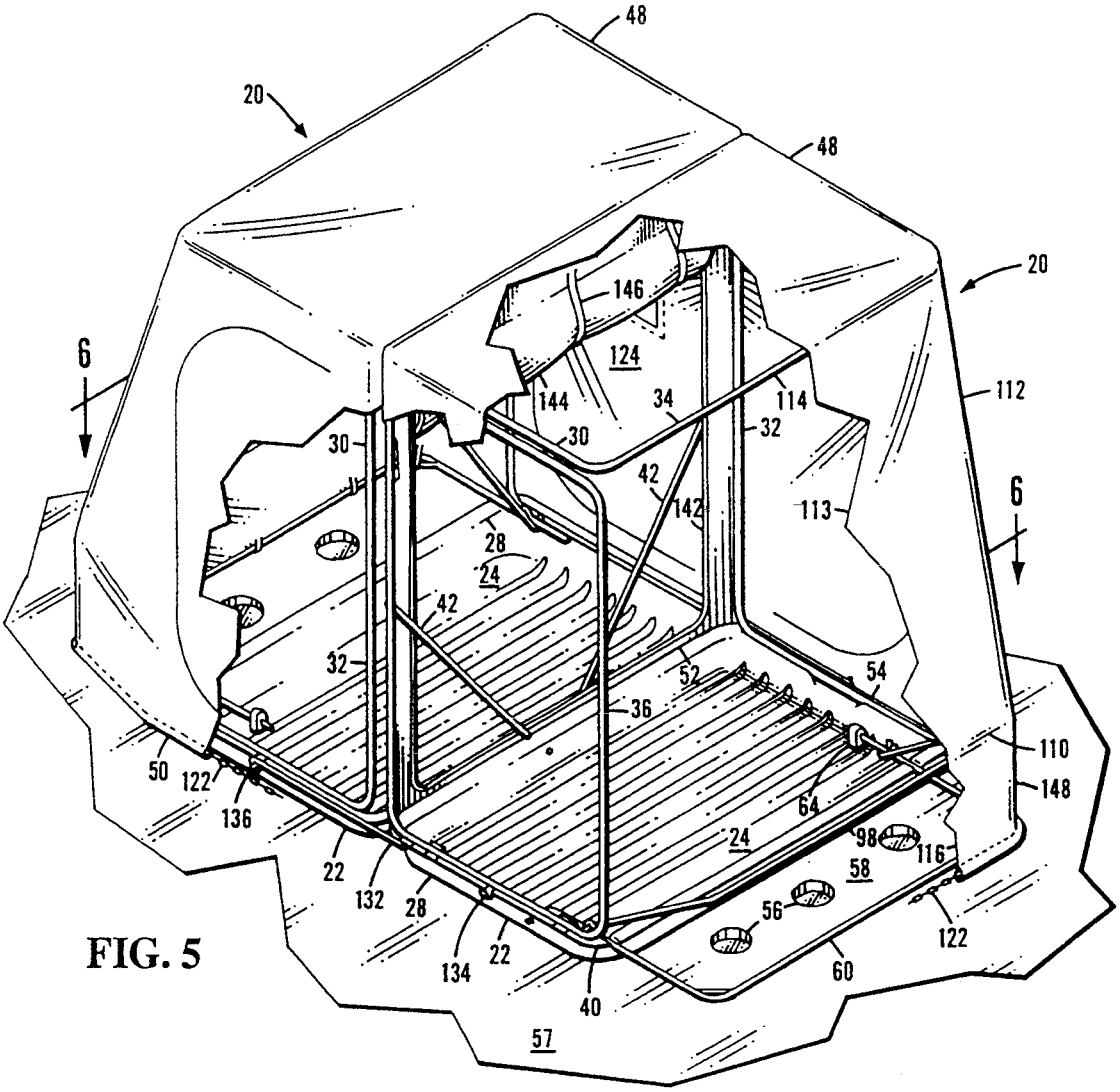
FIG. 5 is an isometric view, partially broken away, of two joined ice fishing shelters of FIG. 3.

As shown in FIGS. 4 and 5, the ice fishing shelter 20 is preferably provided with a chain link chain 122 enclosed within the hem 50 of the flexible covering 48 surrounding the ice fishing region 58. The hem 50 is weighted down by the chain 122 to maintain tight engagement with the ice 57 on which the shelter 20 is positioned. The chain-weighted hem 50 is particularly advantageously employed for early season ice fishing when the ice 57 has not yet been covered with snow and there is no readily available material for weighing down the flexible covering to secure engagement with the ice 57. It should be noted that other dense flexible material such as sand or shot may be alternatively sewn into the hem 50.

The shelter 20 is preferably provided with a door 124 formed in the flexible covering 48 and secured by a zipper 126. The door has a hem 128 which encloses a chain segment 130.

The ice fishing shelter 20 illustrated in FIGS. 2–4 may accommodate three anglers sitting side-by-side. Although it would be possible to fabricate ice fishing shelters having a base which is substantially larger to accommodate more anglers, such an enlarged base would be less convenient to transport. However, it is in some cases desirable to accommodate fishing parties of more than three persons. The ice fishing shelter 20 is provided with features which permit a modular expansion of the sheltered area.

Figure 6:
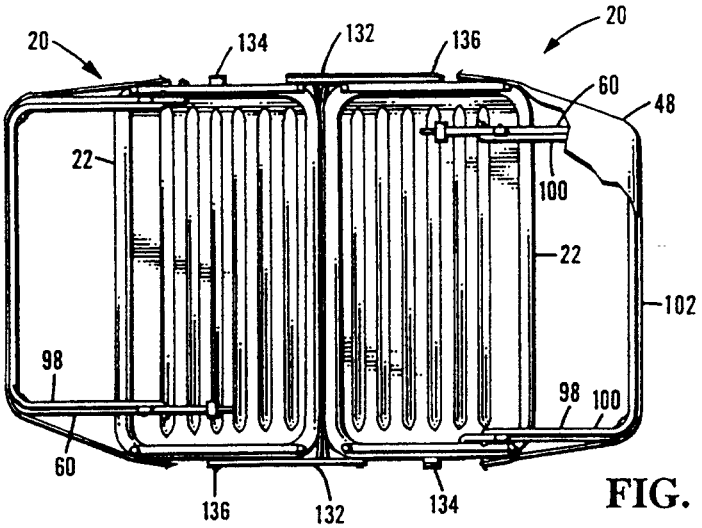
FIG. 6 is a cross sectional view, partially broken away, taken along section line 6—6 of FIG. 5.

As best shown in FIGS. 5 and 6, two identical ice fishing shelters 20 may be positioned back-to-back and connected together to form two contiguous intercommunicating shelters. One side of the base 22 is provided with a hook 132 which is pivotably connected to the base side wall 28 and is pivotable between a stowed position in which the hook is held in place by a clip 134, and an extended position in which the hook 132 engages with a pin 136 located on the opposing shelter 20. Each shelter 20 has a pin 136 connected to the side 54 of the base side wall 28 opposite the hook 132. The hook 132 may be formed of 3/16" flat stock aluminum or similar material.

To reduce wind infiltration between the two connected shelters 20, two strips of hook and loop fastening material 138, 140, as shown in FIG. 4, are positioned on the rear flap 142 of the flexible covering 48. When positioned back-to-back the hook strip 138 of one shelter 20 will be engagable with the loop strip 140 of the second shelter 20. Each shelter also has a zippered rear door 144 which may be rolled up and stowed with flexible ties 146 when two shelters are connected.

The flexible covering 48, as shown in FIG. 3, is preferably tailored to provide vertical seams 148 extending between the first and second braces 60, 98. This tailoring ensures a more snug fit of the flexible covering 48 with less loose fabric available to deflect inwardly.

It should be noted that shelters 20 having smaller bases and designed to accommodate one or two anglers may also be provided with the above features to allow the connection of the smaller shelters to accommodate greater numbers of anglers.

Figure 7:
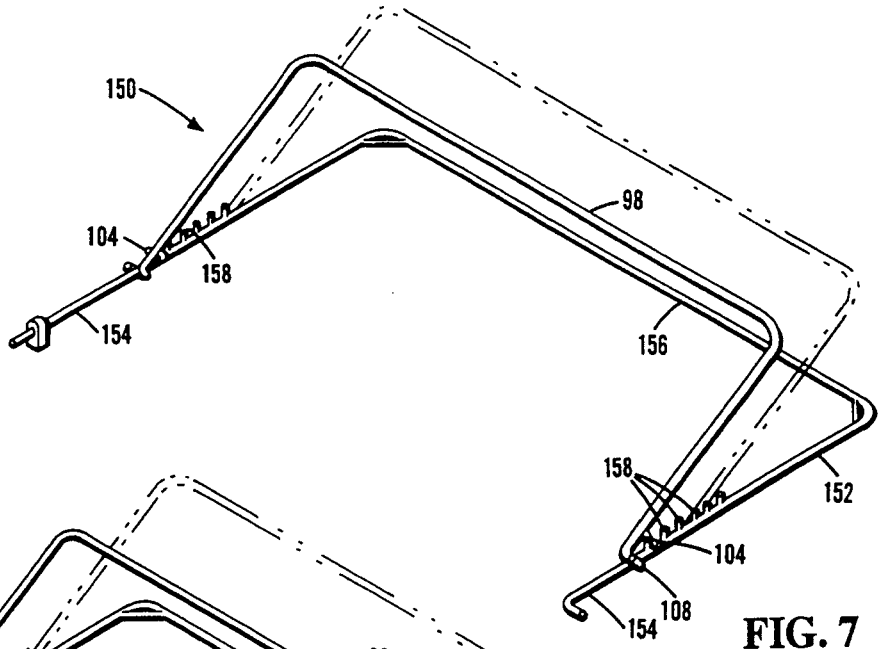
FIG. 7 is an isometric view of an alternative brace assembly for retrofitting a prior art ice fishing shelter.

It should be noted that in some cases it may be desirable to modify a prior art shelter 76 at a minimum cost. An alternative brace assembly 150 is shown in FIG. 7. For use within a variety of shelters, the alternative brace assembly 150 is adjustable to properly tension the front flap of the prior art shelter. The brace assembly 150 has a second brace 98 identical to the second brace of the fishing shelter 20. The first brace 152 of the alternative brace assembly 150 has two frontwardly extending segments 154 joined by a front segment 156. The frontwardly extending segments 154 have a plurality of upwardly extending pins 158. The pins 158 are closely spaced to receive the sidewardly extending pins 104 of the second brace 98. By selecting a pair of pins at an appropriate position, the brace assembly 150 may be configured to apply the proper degree of tension to the front flap of a fishing shelter flexible covering.

Figure 8:
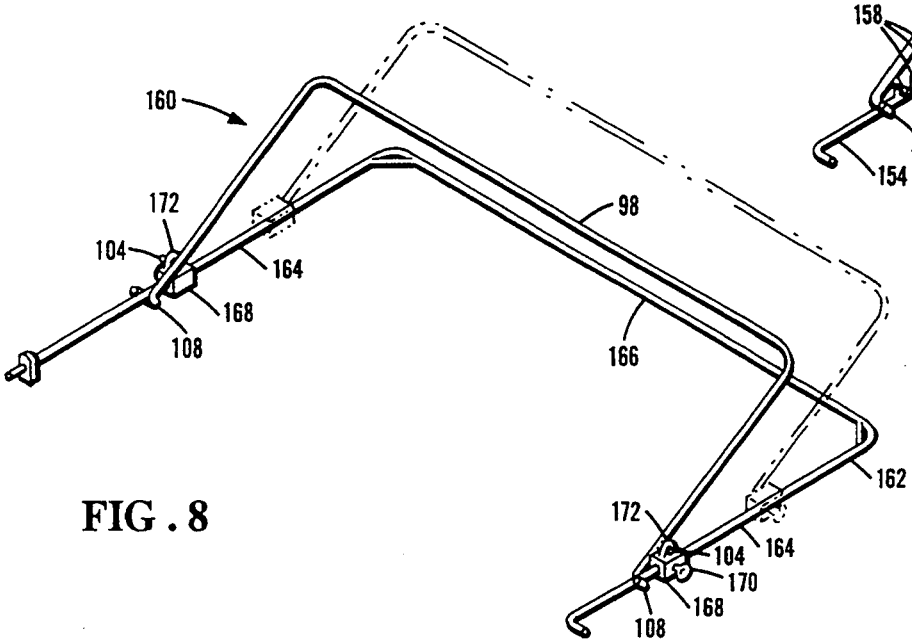
FIG. 8 is a second alternative embodiment of a brace assembly for retrofitting an ice fishing shelter.
Figure 9:
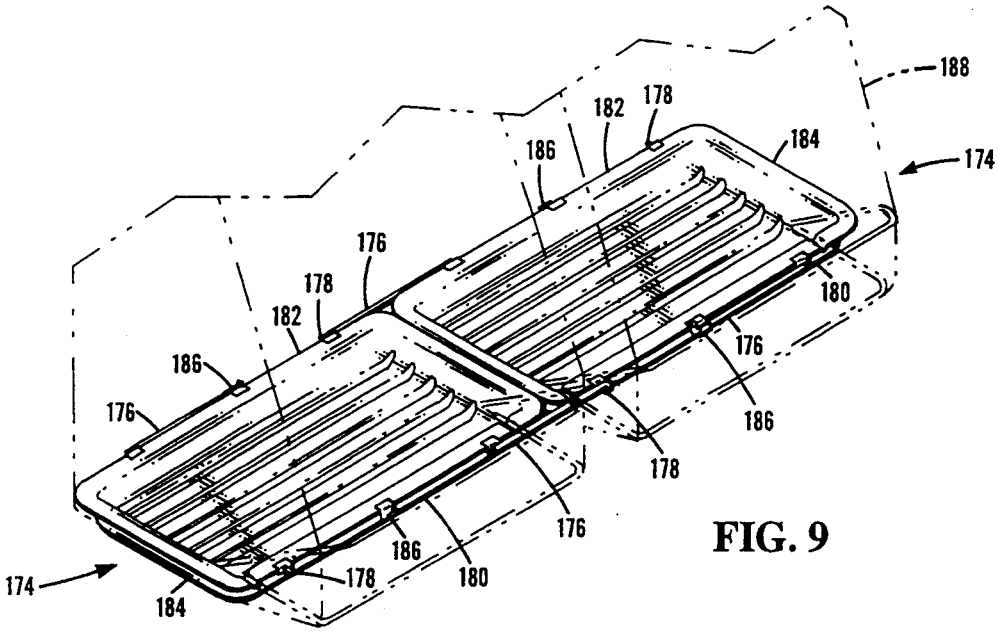
FIG. 9 is an isometric view of two alternative embodiment ice fishing shelters for side to side connection, with the enclosures shown in phantom view.

A second alternative brace assembly 160 is shown in FIG. 8. The alternative brace assembly 160 again has a second brace 98 substantially the same as that shown in the fishing shelter 20. The first brace 162 has two frontwardly extending segments 164 joined by a front segment 166. Each frontwardly extending segment 164 has a slider block 168 mounted thereon for frontward and rearward sliding movement. A set screw 170 extends through the slider block for engagement with the front segment 166. A rigid loop 172 extends upwardly from each slider block 168 and is adapted to receive a pin 104 extending sidewardly from the second brace 98. The second brace may thus be displaced frontwardly or rearwardly by adjustment of the set screws 170 and slider blocks 168.

It should also be noted that a fishing shelter 174 of this invention may be formed for side-by-side connection. The fishing shelter 174, shown in FIG. 9, has a hook 176 and pin 178 on both the front 180 and rear 182 of the base 184. When the shelters 174 are used individually, the hooks 176, which are pivotally connected to the base 184, may be stored in clips 186 extending from the base. The flexible covering 188, shown in phantom, is provided with a side door for communication between the connected shelters 174.

It should be understood that this invention is not limited to the particular construction and arrangement of parts herein illustrated and described, but embodies all such modified forms thereof as come within the scope of the following claims.

We claim:

1. A collapsible ice fishing shelter comprising:

a) a base having a floor with an upwardly extending side wall;

b) a collapsible frame connected to the base, the frame extending above the base to define an enclosed space adapted for human occupation wherein the frame has a frontwardly facing upper segment;

c) a flexible covering engaged with the frame to surround the enclosed space;

d) a first brace which is connected to the base and which has a segment which protrudes frontwardly from the base and which engages against a lower edge of the flexible covering, and which defines an area adjacent to the base which is adapted to surround an ice fishing hole positioned above a body of water, wherein the frame upper segment and the first brace engage against the flexible covering to define a frontwardly facing front flap; and e a second brace extending upwardly and frontwardly from the base towards the flexible covering, the second brace having a segment which engages against the flexible covering above the first brace protruding segment, wherein the second brace segment divides the front flap into two portions, an upper portion and a lower portion, and the lower portion is smaller than the upper portion, and wherein the first brace segment and the second brace segment restrict the lower portion of the flexible covering from deflection toward the base, and thereby define a volume adjacent to the enclosed space above the ice fishing hole which is protected from interference from the flexible covering, wherein the first brace has two frontwardly extending segments joined by the frontwardly protruding segment, and wherein one frontwardly extending segment has a protrusion attached thereto for engagement against the floor of the ice fishing shelter base, and the other frontwardly extending segment has portions for engagement with the side wall of the base; and wherein the second brace has two frontwardly and upwardly extending segments which adjoin the engaging segment, wherein the second brace frontwardly extending segments have rear hooks which hook beneath the first brace frontwardly extending segments, and the second brace frontwardly extending segments have sidewardly extending pins which are engaged with the first brace frontwardly extending segments in pivotal relation, wherein the hooks limit the pivoting of the second brace with respect to the first brace.

2. The ice fishing shelter of claim 1 further comprising a plurality of upwardly extending pins protruding from each of the first brace frontwardly extending segments, wherein the second brace may be selectably positioned between pins, to control the forward position of the second brace front segment.

3. The ice fishing shelter of claim 1 further comprising:

a) a slider block slidably mounted to each of the first brace frontwardly extending segments;

b) a loop extending upwardly from each slider block;

c) a set screw extending through each slider block for releasable engagement with the first brace frontwardly extending segment to which the slider block is mounted, such that the slider block and loop may be positioned at any desired position along the length of the first brace frontwardly extending segment, and wherein the second brace pins are engaged within the slider block loops such that the front segment of the second brace may be positioned at a desired location to apply appropriate tension to the flexible covering.

4. The ice fishing shelter of claim 1 further comprising:

a) a hem formed in the flexible covering adjacent to the area defined by the first brace;

b) a chain enclosed within the hem, the weight serving to retain the flexible covering hem in contact with a surface upon which the shelter is supported.

* * * * *